US010710098B2

(12) United States Patent
Marra

(10) Patent No.: US 10,710,098 B2
(45) **Date of Patent: *Jul. 14, 2020**

(54) CLEANING DEVICE FOR CLEANING AN AIR-IONIZING PART OF AN ELECTRODE

(71) Applicant: KONINKLIJKE PHILIPS N.V., Eindhoven (NL)

(72) Inventor: Johan Marra, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 414 days.

This patent is subject to a terminal disclaimer.

(21) Appl. No.: 15/409,850

(22) Filed: Jan. 19, 2017

(65) Prior Publication Data

US 2017/0144167 A1 May 25, 2017

Related U.S. Application Data

(63) Continuation of application No. 14/125,318, filed as application No. PCT/IB2012/052998 on Jun. 14, 2012, now Pat. No. 9,579,644.

(30) Foreign Application Priority Data

Jun. 22, 2011 (EP) ..... 11170942

(51) Int. Cl.
*B03C 3/74* (2006.01)
*B03C 3/76* (2006.01)
(Continued)

(52) U.S. Cl.
CPC ..... *B03C 3/743* (2013.01); *B03C 3/41* (2013.01); *B03C 3/47* (2013.01); *B03C 3/765* (2013.01);
(Continued)

(58) Field of Classification Search
CPC combination set(s) only.
See application file for complete search history.

(56) References Cited

U.S. PATENT DOCUMENTS 2,954,701 A * 10/1960 Berill ..... B41J 33/00 310/23
3,253,098 A * 5/1966 Perry ..... H01H 33/666 335/170
(Continued)

FOREIGN PATENT DOCUMENTS

CN 2678774 Y 2/2005
EP 1781481 B1 4/2009
(Continued)

OTHER PUBLICATIONS

Marra J. et al., "Monitor for Detecting and Assessing Exposure to Airborne Nanoparticles"; Journal of Nanoparticle Research, Jan. 2010, vol. 12, Issue 1, pp. 21-37.*
(Continued)

*Primary Examiner* — Christopher P Jones
*Assistant Examiner* — Sonji Turner

(57) ABSTRACT

A cleaning device for cleaning an air-ionizing part of an electrode. The device comprises a cleaning member arranged to be in physical contact with the air-ionizing part of the electrode, the air-ionizing part of electrode and the cleaning member being arranged to slide relative to each other. The cleaning device further comprises an actuator arranged to activate the relative motion between the air-ionizing part of the electrode and the cleaning member. There is also provided an ionization electrode comprising the air-ionizing part and the cleaning device, as well as a ultrafine particle sensor, an air ionizer or an electrostatic air cleaner comprising such an electrode.

9 Claims, 3 Drawing Sheets

(51) Int. Cl.
*B03C 3/41* (2006.01)
*H01T 23/00* (2006.01)
*B03C 3/47* (2006.01)

(52) U.S. Cl.
CPC ..... *H01T 23/00* (2013.01); *B03C 2201/04* (2013.01); *B03C 2201/06* (2013.01); *B03C 2201/24* (2013.01); *B03C 2201/32* (2013.01)

(56) References Cited

U.S. PATENT DOCUMENTS

| | | | | |
|---|---|---|---|---|
| 3,792,390 | A * | 2/1974 | Boyd | H01H 71/322 335/174 |
| 3,828,288 | A * | 8/1974 | Boyd | G08B 5/22 335/234 |
| 4,318,718 | A | 3/1982 | Utsumi | |
| 4,524,411 | A | 6/1985 | Schmidt | |
| 4,698,586 | A * | 10/1987 | Roos | G08B 17/11 324/464 |
| 5,249,094 | A | 9/1993 | Hayakawa | |
| 5,768,087 | A | 6/1998 | Vernitskiy | |
| 6,348,103 | B1 | 2/2002 | Ahlborn | |
| 6,464,754 | B1 | 10/2002 | Ford | |
| 6,635,105 | B2 | 10/2003 | Ahlborn | |
| 6,709,484 | B2 | 3/2004 | Lau | |
| 6,791,814 | B2 | 9/2004 | Adachi | |
| 6,855,190 | B1 | 2/2005 | Nikkhah | |
| 7,115,153 | B2 | 10/2006 | Ahlborn | |
| 7,220,295 | B2 | 5/2007 | Lau | |
| 7,408,759 | B2 | 8/2008 | Gefter | |
| 7,836,751 | B2 | 11/2010 | Marra | |
| 7,966,862 | B2 * | 6/2011 | Gualtieri | G01N 15/0656 73/28.01 |
| 8,043,573 | B2 * | 10/2011 | Parker | A61L 9/22 422/186 |
| 8,724,286 | B2 | 5/2014 | Uchida | |
| 9,579,664 | B2 * | 2/2017 | Marra | H01T 3/00 |
| 2003/0098650 | A1 | 5/2003 | Adachi | |
| 2005/0160906 | A1 | 7/2005 | Reeves | |
| 2005/0210902 | A1 | 9/2005 | Parker | |
| 2006/0055251 | A1 | 3/2006 | Hsian | |
| 2007/0235661 | A1 | 10/2007 | Gefter | |
| 2008/0092742 | A1 * | 4/2008 | Marra | B60H 1/008 96/16 |
| 2009/0188300 | A1 * | 7/2009 | Gualtieri | F02D 41/1466 73/28.01 |
| 2009/0274592 | A1 | 11/2009 | Bergeron | |
| 2010/0033891 | A1 | 2/2010 | Orihara | |
| 2010/0067939 | A1 | 3/2010 | Inoue | |
| 2010/0188793 | A1 | 7/2010 | Uchida | |
| 2013/0283887 | A1 * | 10/2013 | Ante | F01N 9/002 73/28.01 |

FOREIGN PATENT DOCUMENTS

| | | | |
|---|---|---|---|
| FR | 0433152 | | 6/1991 |
| JP | H04170007 | A | 6/1992 |
| JP | H07300831 | A | 11/1995 |
| JP | 2000-146887 | * | 5/2000 |
| JP | 2002043092 | A | 2/2002 |
| JP | 2002248386 | A | 9/2002 |
| JP | 2005168796 | A | 6/2005 |
| JP | 2009129549 | A | 6/2008 |
| WO | 2010061327 | A1 | 6/2010 |

OTHER PUBLICATIONS

Dorsey J.A. et al., "Ozone Production in Electrostatic Air Cleaners with Contaminated Electrodes", IEEE Transactions on Industry Applications, vol. 30, No. 2, Mar./Apr. 1994, pp. 370-376.

* cited by examiner

CLEANING DEVICE FOR CLEANING AN AIR-IONIZING PART OF AN ELECTRODE

FIELD OF THE INVENTION

The invention relates to a cleaning device for cleaning the air-ionizing part of an electrode. The invention also relates to an ionization electrode comprise in the cleaning device, and to an ultrafine particle sensor, an air ionizer and an electrostatic air cleaner comprising the ionization electrode.

BACKGROUND OF THE INVENTION

Air ionization electrodes are used in equipments such as photocopiers, electrical air cleaners, air ionizers and ultrafine particle sensors. They are frequently embodied as thin-wire electrodes or needle-tip electrodes and are connected to a high voltage (HV) supply, which is set at a voltage ($V_{cor}$) that is sufficiently high to ionize the air in the direct vicinity of the ionization electrode. In case a positive HV is used, the ionization electrode effectively emits airborne positive ions. Negative ions are emitted when a negative HV is used. The emitted ions can attach themselves to airborne particles, thereby charging the particles. In air cleaners, particle charging is useful to increase the particle capturing efficiency in charged media filters positioned downstream from the particle charging section. Concerning air ionizers, emitted ions (often present as a bipolar mixture) serve to prevent the build-up of static charges on surfaces through charge neutralization. In ultrafine particle (UFP) sensors, emitted ions serve to charge particles in the airflow passing through the sensor. The UFP sensor subsequently determines the airborne particle concentration by measuring the particle-bound charge (see e.g. J. Marra; Journal of Nanoparticle Research (2010), Vol. 12, pp. 21-37).

An important requirement for an ionization electrode is that the total emitted ionization current remains constant in time. This is usually fulfilled by introducing an electronic feedback mechanism, which ensures that the voltage applied to the ionization electrode is always such that a constant pre-set ionization current is emitted.

A further important requirement for an ionization electrode is that the spatial ion emission density around the electrode exhibits cylindrical symmetry (in which case the wire or needle being the axis of a cylinder) and remains substantially unchanged in the course of time. This is especially important for UFP sensors to ensure a uniform and predictable degree of particle charging at all locations within their particle charging section. However, due to the gradual (non-uniform) deposition of contaminants from air on the ionization electrode, this requirement is not always guaranteed. The deposits or contaminants on the electrode may consist of deposited particulate species, but also of $NH_4NO_x$ and $SiO_2$ residues. A build-up of $NH_4NO_x$ results from the oxidation of $N_2$ into $NO_x$ within the corona plasma region around the ionization electrode and the subsequent reaction of $NO_x$ with $NH_3$ gas in the presence of moisture to form the solid $NH_4NO_x$ (x=2 or 3) salt. $SiO_2$ is formed as a leftover from the oxidation of silicone-containing gases in the corona plasma region. These deposits are insulating in nature and their formation and growth on an ionization electrode is experienced to gradually change the spatial characteristics of the emitted ion density around the electrode. In case needle-tip electrodes are used, the plasma region wherein air ionization occurs is mostly confined to the electrode tip. Contaminating deposits are therefore predominantly found at or in direct proximity to the electrode tip. In case thin-wire electrodes are used, air ionization and thus also the formation of contaminating deposits occurs across the entire length of the wire. In UFP sensors the presence of such deposits/contaminants affect the particle charging behavior in the course of time, thereby reducing the reliability of these devices. This is a problem since such sensors rely on the correct interpretation of measured current signals into key characteristics of the UFP pollution, notably the UFP number concentration N and the average particle size $d_{p,av}$. Eventually, small amounts of the deposit may be released back into air as nanoparticles under the influence of the local corona current, thereby further affecting the reliability of the readings of UFP sensors. This problem is quite serious when UFP measurements are carried out in indoor environments, which are always to some extent polluted with silicone-containing gases.

To deal with this contamination problem, the ionization electrode(s) may be manually cleaned from time to time. Further, a few cleaning devices have been suggested, such as specific brushes disclosed in U.S. Pat. No. 5,768,087, but the scope of their applicability is severely limited. Moreover, cleaning may be costly and time consuming. The installation of an activated carbon filter upstream of the ionization electrode may adsorb silicone gases from sampled air but is not acceptable for UFP sensors because the presence of such a filter also affects the UFP concentration in the sampled air which one wants to measure. An activated carbon filter is not effective for avoiding the deposition of particulate contaminants or of $NH_4NO_x$ onto the ionization electrode. Thus, there is a need in the art for improved or alternative cleaning devices for air-ionization electrodes such as needle-tip or thin-wire electrodes.

SUMMARY OF THE INVENTION

It is an object of the present invention to provide an improvement of the above techniques and prior art. The above object is provided according to a first aspect of the invention by a cleaning device for cleaning the air-ionizing part of an electrode, the device comprising a cleaning member arranged to be in physical contact with the air-ionizing part of the electrode, the air-ionizing part of electrode and the cleaning member being arranged to slide relative to each other. The cleaning device further comprise an actuator arranged to activate the relative motion between the air-ionizing part of the electrode and the cleaning member.

Cleaning of the electrode may involve the removal or partly removal of deposits or contaminants adsorbed or deposited on the air-ionizing part of the electrode. Such contaminants usually decrease the performance of the air-ionizing electrode, thus influencing the spatial characteristics of the emitted ion density around the air-ionizing electrode in a negative way. The contaminants may be particulate contaminants but also build-up of, for example, $NH_4NO_x$ and $SiO_2$ residues.

The air-ionizing part of the electrode may comprise a needle-tip or a thin wire. Thus, the electrode may for example be a needle-tip electrode or a thin wire electrode. A needle-tip electrode refers to a needle-tip electrode suitable for applications in ultrafine particle sensors (UFP), air ionizers and particle chargers in electrostatic air cleaners. The needle-tip electrode may thus have the capacity to ionize air in the vicinity of the sharp tip of the needle-tip electrode, i.e. it may be an ionization electrode. A needle-tip electrode of the present disclosure will normally be connected to a high voltage (HV) supply. Instead of a needle-tip electrode, also thin-wire electrodes may be used for the purpose of air ionization. Air ionization then occurs across the whole length of the thin wire when the electric field at the surface of the thin wire is made sufficiently high to locally ionize the air.

The first aspect of the invention is based on the insight that a cleaning device comprising a cleaning member arranged to be in physical contact with the outer surface of the air-ionizing part of an electrode, wherein the electrode and the cleaning member are arranged to slide relative to each other and wherein the cleaning device further comprises an actuator for activating such a motion, is an excellent tool for removing contaminants from air-ionizing electrode surfaces. The actuator of the cleaning device of the first aspect of the invention thus provides for automatic and even periodic cleanings of the electrode surfaces, i.e. without any need for manual cleaning. Hence, a cleaning device according to the first aspect of the invention may be capable of periodically performing automatic cleanings of an air-ionizing electrode from undesirable deposits. Further, the cleaning frequency may be chosen such that a sufficiently clean ionization electrode is guaranteed at all times. The presence of an actuator ensures a much extended maintenance-free operational period of e.g. UFP sensors, air ionizers or air cleaners.

During cleaning of the air-ionizing electrode surface, the cleaning member may move relative to the electrode surface or vice versa, i.e. the electrode surface may also move relative to the cleaning member. Consequently, the cleaning member may slide along the air-ionizing electrode surface while the electrode is in a fixed position or the electrode surface may slide along the cleaning member while the cleaning member is in a fixed position.

Thus, the cleaning member may be arranged to slide along the length of the air-ionizing part of the electrode while being in physical contact with the electrode.

During cleaning, a shearing force is applied onto the surface of the air-ionizing electrode part as the cleaning member moves relative to the electrode, which physically or mechanically removes or at least reduces deposited contaminants from the electrode surface. A shearing force refers to a force that is applied parallel or tangential to the surface of the air-ionizing part of the electrode.

In embodiments of the first aspect of the invention, the cleaning member may be arranged to be in contact with the circumference of the air-ionizing part of an electrode This is thus advantageous since it provides for cleaning of substantially the whole surface area of the air-ionizing part of an electrode during a single slide of the cleaning member.

Consequently, the air-ionizing part of the electrode may comprise a needle-tip or a thin wire and the cleaning member may be arranged to be in contact with the circumference of the needle-tip or the thin-wire part of the electrode.

The actuator may enable a motion of either the air-ionizing part of the electrode or of the cleaning member. This provides for activating the cleaning of the surface of the air-ionizing part of the electrode by the action of the actuator.

In embodiments of the first aspect of the invention, the actuator may be an electromagnetic actuator. The electromagnetic actuator may be an electromagnetic assembly comprising a magnet and an electrical-wire coil. This is advantageous in that it provides for electromagnetically activating the actuator by creating a magnetic force between the magnet and an electrical current passing through the coil. A magnetic force may be used for enabling the physical movement of either the air-ionizing part of the electrode or of the cleaning member, which is a convenient way of inducing the cleaning of the air-ionizing electrode surface.

As an example, the actuator may furthermore comprise a spring, which provides for a better control of the magnetic force-enabled physical movement.

Consequently, the actuator may be an electromagnetic assembly comprising a spring, an electrical-wire coil, and a magnet.

It is advantageous when either the electrical-wire coil or the magnet is comprised in a piston assembly, whereby the piston assembly is spring-loaded in a support assembly around the piston by means of the spring. For instance, the magnet may be comprised in the piston assembly, while the coil is comprised in the support assembly.

Consequently, the cleaning device may further comprise a moveable piston assembly that is spring-loaded via the spring, the piston assembly comprising either the magnet or the electrical-wire coil. The moveable piston assembly may be spring-loaded in a support assembly.

A magnetic force between the magnet and the electrical current passing through the coil will then result in a net force on the piston assembly relative to the support assembly, which may result in piston motion when the magnetic force is sufficiently strong to overcome the spring compression that accompanies piston movement in the holder assembly. In this embodiment, the piston may be enabled to move relative to the support assembly between two positions in response to the electromagnetic activation or de-activation of the actuator. The two positions may be extreme positions that are fixed by mechanical constraints. Activation of the actuator may thus occur when a pre-set electrical current is passed through the electrical-wire coil. De-activation of the actuator occurs when the pre-set electrical current is withdrawn from the electrical-wire coil. An advantageous embodiment is obtained when the cleaning member is connected to the piston assembly such that the cleaning member moves relative to the air-ionizing part of the electrode between a first position and a second position due to the action of the spring, the first position corresponding with a first degree of compression of the spring, the second position corresponding with a second degree of compression of the spring.

Hence, the cleaning member may then be moved, relative to the air-ionizing part of the electrode, from a first position, corresponding with a first degree of spring compression, to a second position, corresponding with a second degree of spring compression.

As an example, the second position may be attained when the actuator is electromagnetically activated by passing a electrical current through the coil, and the first position may be attained when the actuator assembly is electromagnetically de-activated by withdrawing the electrical current from the coil.

The electrical current may be a pre-set electrical current.

The second position may thus correspond to the situation wherein the actuator is electromagnetically activated, and the first position may correspond to the situation wherein the actuator is electromagnetically de-activated. The second position can then be reached from the first position when the magnetic force between the magnet and the coil is sufficient to further compress the spring from the first degree of spring compression to the second degree of spring compression. When the actuator is de-activated, the magnetic force between the coil and the magnet is reduced or disappears altogether and the compressed spring will at least partly de-compress by moving the piston from the second position back to the first position.

As an example, the first position and the second position may be arranged such that the cleaning member slides along the length of substantially the entire air-ionizing part of the electrode when moving from the first position to the second position or vice-versa.

It is particularly advantageous when the first and second positions are chosen such that the cleaning member slides along the entire air-ionizing surface of the electrode when moving from the first position to the second position or vice-versa. This is useful for cleaning the entire air-ionizing surface of the electrode during a single motion of the cleaning member when moving from the first position to the second position or vice-versa. In fact, the air-ionizing surface may be cleaned twice during a single piston stroke. By applying the electrical current through the coil as a short-duration pulse, the accompanying piston stroke will also be of short duration. Further, the frequency at which the needle-tip is cleaned may be set by the frequency at which a current is applied to the coil, i.e. the pulse frequency.

In embodiments of the first aspect of the invention, the cleaning member comprises a sheet or foil with at least one perforation through which the air-ionization part of the electrode slides.

If the ionization part of the electrode is embodied as a needle-tip or as a thin wire, the needle-tip electrode or thin-wire electrode may thus be in physical contact with the cleaning member as it protrudes through the perforation, and movement of the cleaning member thus applies a shearing force onto the surface of the needle-tip or the thin wire at the site of protrusion as the cleaning member slides along the needle-tip or the thin wire, respectively. It is preferred that the edges of the perforation are able to touch each other such that at least one perforation is substantially closed by having edges in contact with each other when the needle-tip does not protrude through the perforation, since this will provide for a shearing force applied by the edges of the perforation as the needle-tip protrudes and slides through the perforation.

As an example, the perforation may be a central hole, a central square cross and/or a central triangular cross through which the air-ionizing part of the electrode may protrude.

Such perforations are suitable for allowing a needle tip or thin wire to pass through the perforation and applying a shearing force onto the surface of a needle-tip or the thin wire when they protrude and slide through the perforations.

As an example, the sheet may be a flexible, perforated foil.

This is advantageous since the shearing force applied to the needle-tip or the thin wire may be altered by changing the stiffness of the foil, e.g. by changing the thickness of the foil or the material from which the foil is made.

As a further example, the foil may be made of soft non-brittle foil material.

A soft non-brittle foil material is for example made from polypropylene, polyethylene or polyester material having a preferable thickness in the range 25-100 μm.

In embodiments of the first aspect of the invention, the cleaning member comprises a porous fibrous material. A suitable flexible porous fibrous material may be obtained from mechanical dust filters, which are normally composed of fibers that are bound or assembled together into an air-permeable and thus porous sheet structure. A sharp needle-tip electrode or thin-wire electrode can readily be made to protrude through the fibrous material, the fibers exerting a shear force onto the electrode surfaces when the electrode is made to slide through the fibrous material. The thickness and porosity of the cleaning member composed of the fibrous material is variable within wide limits, which is convenient for adapting and optimizing the applied shearing force onto the electrode surfaces.

In embodiments of the first aspect of the invention, the cleaning member comprises a supported granular material. A suitable granular material is for instance a fine sand composed of inorganic compounds such as alumino-silicates, $SiO_2$ or $Al_2O_3$. Preferably, the granular material is contained between two parallel porous gauzes, wherein the pores are smaller than the size of the granules but sufficiently large to accommodate a protrusion of a needle-tip electrode or a thin-wire electrode through the gauzes. When an electrode is made to slide through the granule-filled cleaning member, the loose granules shear against the electrode surfaces and clean them from deposits thereon.

It is to be understood that any material that provides a shearing force to the air-ionizing part of an electrode may be used in the cleaning member according to the present disclosure.

In embodiments of the first aspect of the invention, there is provided an air-ionizing part and a cleaning device as defined above.

As an example, the cleaning member of the cleaning device may be arranged to move relative to the air-ionizing part. This means that the air-ionizing part may be fixed as the cleaning member slides along the air-ionizing part during cleaning.

In embodiments of the first aspect of the invention, there is provided a ultrafine particle sensor, an air ionizer or an electrostatic air cleaner comprising an electrode as defined hereinabove.

Further features of, and advantages with, the present invention will become apparent when studying the appended claims and the following detailed description. Those skilled in the art realize that different features of the present invention can be combined to create embodiments other than those explicitly described in the following.

BRIEF DESCRIPTION OF THE DRAWINGS

Aspects of the present invention will now be described in more detail, with reference to the appended drawings showing currently preferred embodiments of the invention.

DETAILED DESCRIPTION OF THE EMBODIMENT

Figure 1:
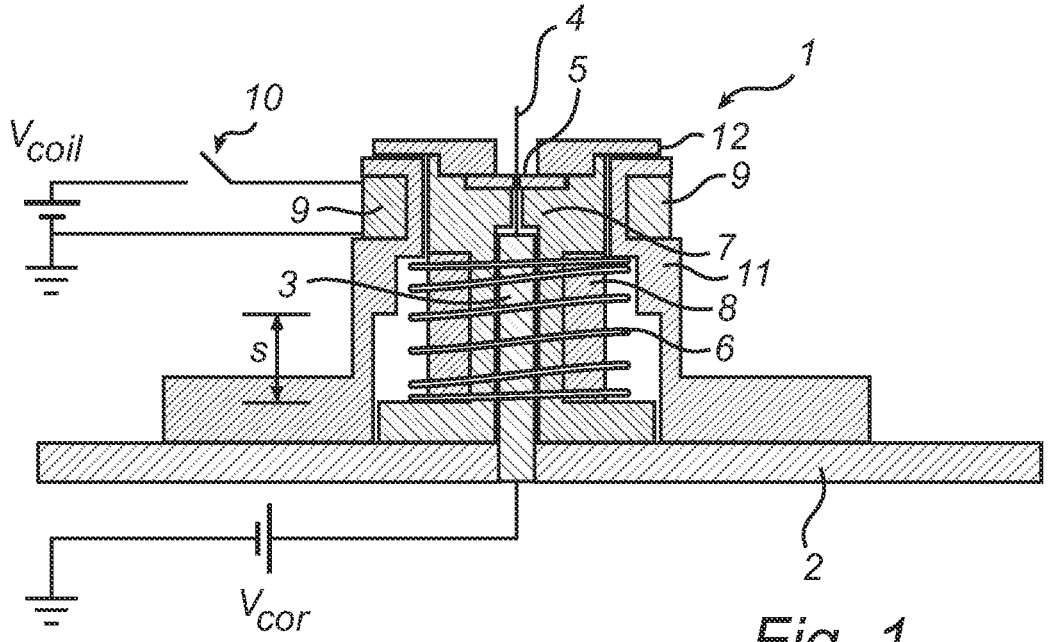
FIG. 1 shows a cross-section of a cleaning device for a needle-tip ionization electrode according to an embodiment of the present invention.
Figure 2:
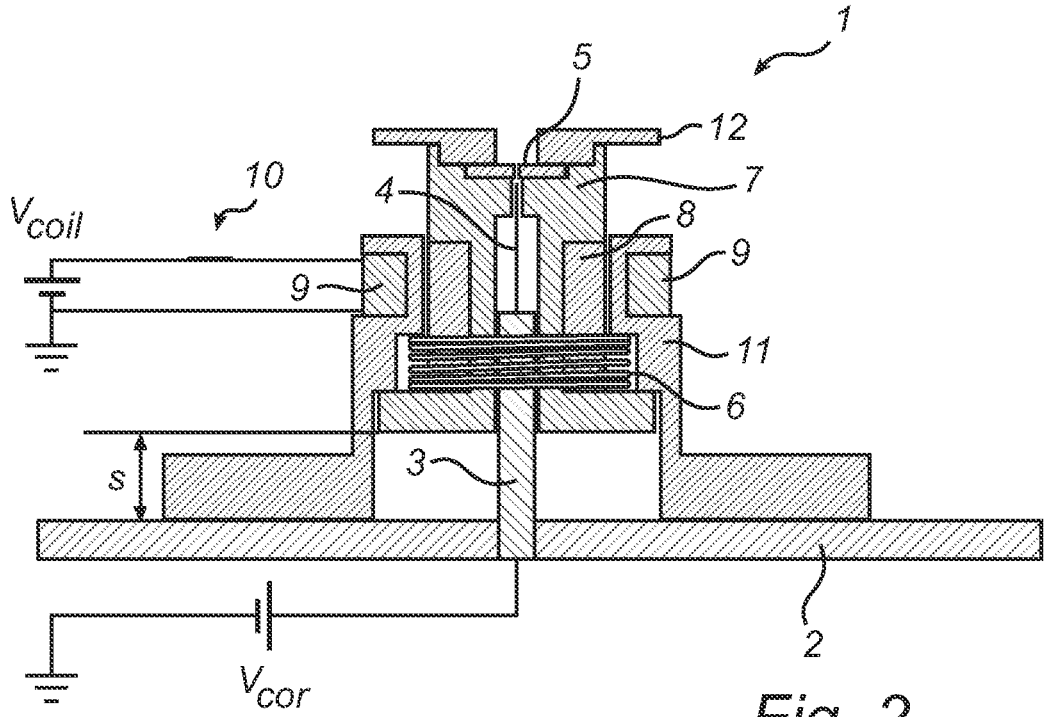
FIG. 2 shows the cleaning device of FIG. 1, in which the spring of the system is in a more compressed state compared to the situation shown in FIG. 1 due to closing of the switch that allows an electric current to flow through the electrical-wire coil.

The schematic design of a cleaning device 1 for removing deposits from a needle-tip ionization electrode according to an embodiment of the invention is shown in FIGS. 1 and 2. The needle-tip ionization electrode 4 is situated at the top of a high voltage (HV) electrode 3, which itself maintains a fixed position on a support plate 2. The HV electrode 3 is operated by a high-voltage supply $V_{cor}$.

The cleaning device 1 comprises a cleaning member 5 arranged to be in physical contact with the outer surface of the needle-tip 4 of the electrode. In this embodiment, the cleaning member 5 is in the form of a clamped perforated flexible foil that is in physical contact with the circumference of the fixed needle-tip electrode.

The cleaning member 5 is attached to a piston assembly 7, which encloses the central high voltage HV electrode 3. There is also a support assembly 11 that surrounds and supports the piston assembly 7 around the electrode 3.

The needle-tip 4 and the cleaning member 5 are arranged to slide relative to each other, as the piston assembly 7 moves relative the central electrode 3. In this embodiment, the needle-tip 4 and the electrode 3 are in a fixed position and the cleaning member 5 slides along the length of the needle as the piston assembly 7 slides along the outer surface of the HV electrode 3, i.e. the cleaning member 5 slides along the surface of the needle-tip 4 during a stroke of the piston 7, the length of which is referred to as "S" in FIG. 1.

Figure 3:
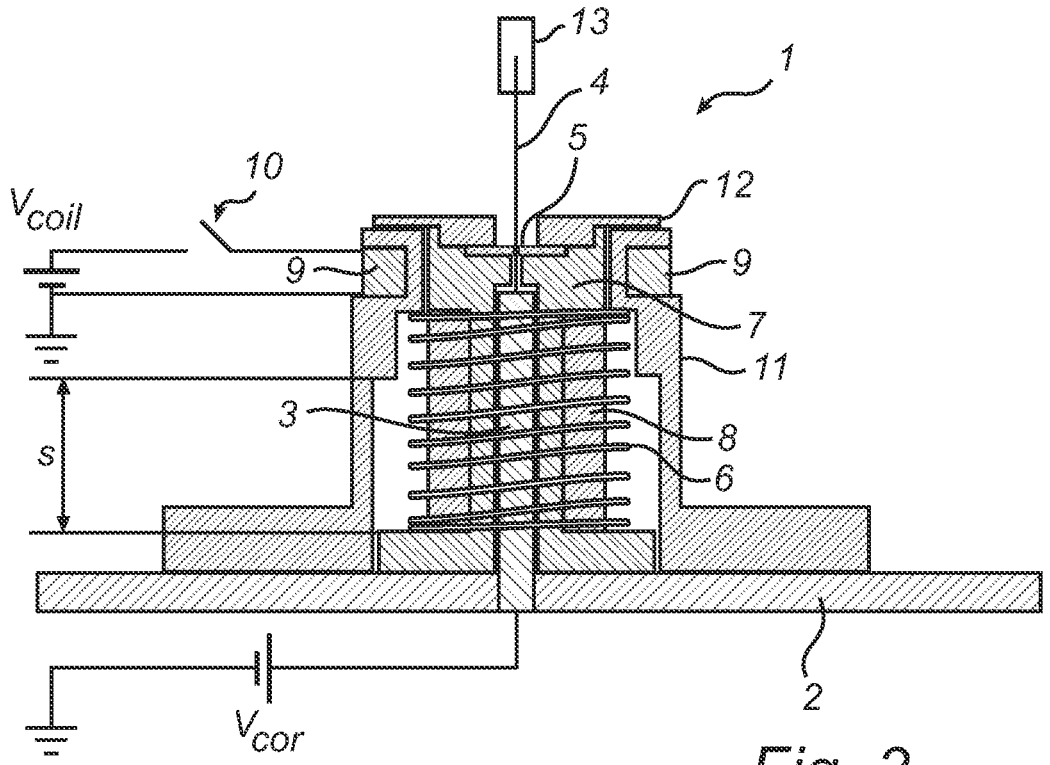
FIG. 3 shows a cross-section of a cleaning device for a thin-wire ionization electrode according to an embodiment of the present invention.
Figure 4:
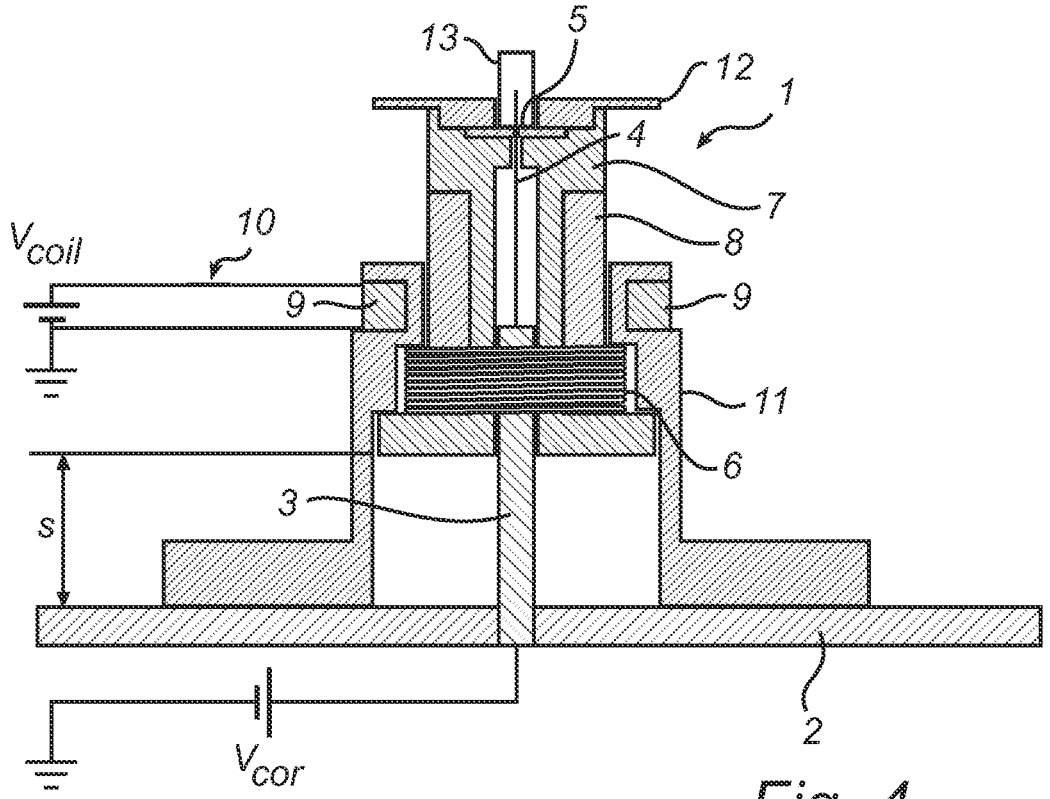
FIG. 4 shows the cleaning device of FIG. 3, in which the spring of the system is in a more compressed state compared to the situation shown in FIG. 3 due to closing of the switch that allows an electric current to flow through the electrical-wire coil.
Figures 5A, 5B, 5C:
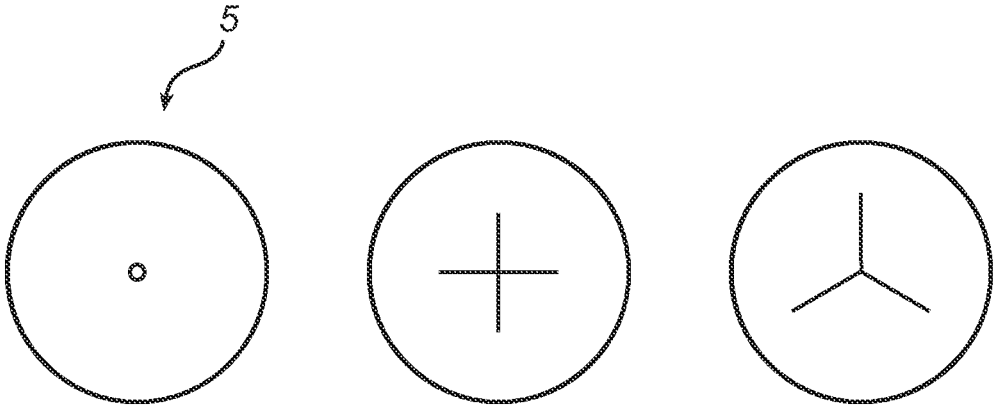
FIG. 5*a*, FIG. 5*b* and FIG. 5*c* show three types of perforations on a flexible, perforated foil that may be used as the cleaning member according to an embodiment of the present invention.

The cleaning device comprises an electromechanical actuator that activates the relative motion of the piston assembly 7 with respect to the electrode 3. The actuator features a spring 6 attached to a permanent magnet, here embodied as a hollow-cylinder magnet 8, and an electrical wire coil 9, which is arranged to exert a magnetic force onto the magnet 8 when an electrical current flows through the electrical wire coil 9. In case no electrical current flows through the coil 9 from $V_{coil}$, i.e. when switch 10 is "open", no magnetic force is exerted onto the magnet 8 and the piston assembly 7 remains in the fixed position due to the presence of the partly compressed helical spring 6, as shown in FIG. 1. The partly compressed state of the helical spring also ensures that the piston assembly 7 remains fixed in its position with respect to the support assembly 11 without possible disturbances from the influence of gravity or incidental mechanical shocks. In case an electrical current flows through the coil 9, i.e. when switch 10 is "closed", a magnetic force is exerted onto the magnet 8. With a properly applied electrical current direction and a sufficiently high current density, the magnet 8 experiences a sufficiently strong upward force which results in an upward motion of the piston assembly 7 along a defined distance S, which is the stroke of the piston, as shown in FIG. 2. The spring 6 is then transferred to a more compressed state compared to when switch 10 is in "open" position. The piston returns to its original position due to the action of the spring 6 when the current is nullified, i.e. when switch 10 is "open" again. During a single stroke of the piston, which thus may be enabled by applying a single electrical current pulse through the coil 9, the cleaning member 5, i.e. the flexible perforated foil, slides twice along the entire length of the needle-tip ionization electrode 4, thereby applying a shearing force onto the surface of the needle-tip, which removes deposited material from the needle-tip electrode 4. The shearing force can be altered by changing the stiffness of the foil 5 e.g. by changing its thickness or changing the material from which the foil 5 is made. In the embodiment shown in FIGS. 1 and 2, the entire needle-tip electrode 4 can be drawn through the perforated foil 5 during a single stroke. The piston assembly 7 is thereby shaped such that the ionization electrode 4 is always sufficiently supported to remain in position without any danger of substantial deformation. By controlling the transfer of switch 10 from "open" to "closed" e.g. setting or programming the transfer to occur after specific time intervals, the cleaning device 1 as shown in FIGS. 1 and 2 is capable of periodically performing automatic cleaning of the needle-tip ionization electrode 4 from undesirable deposits. The cleaning frequency can be chosen such that a sufficiently clean ionization electrode 4 is guaranteed at all times. The presence of this actuator 1 ensures a much extended maintenance-free operational period of an UFP sensor, air ionizer or air cleaner. A schematic design of a cleaning device 1 for removing deposits from a thin-wire electrode according to another embodiment of the invention is shown in FIGS. 3 and 4. The thin-wire electrode therein replaces the needle-tip electrode in FIGS. 1 and 2. The thin-wire electrode is the air-ionizing part of the high-voltage electrode 3. On one end, the thin-wire electrode is attached to electrode 3. On the opposite end, the thin-wire electrode is capped and supported in its position by the insulating element (13) which will normally be part of the apparatus in which the cleaning device 1 is comprised. The cleaning device 1 shown in FIGS. 3 and 4 functions entirely analogous to the cleaning device 1 shown in FIGS. 1 and 2 and it is referred to the previous discussion pertaining to the cleaning device 1 comprising a needle-tip electrode for a detailed explanation about the cleaning device 1 comprising a thin-wire electrode. As in the device shown in FIGS. 1 and 2, the cleaning member 5 of the device in FIGS. 3 and 4 is contained in the piston assembly 7. The piston assembly 7 and the support assembly 11 in the device shown in FIGS. 3 and 4 are configured such that the length of the piston stroke S is sufficient to shear the cleaning member 5 along substantially the entire length of the thin-wire electrode, thereby enabling the removal of contaminating deposits from the surface of the thin-wire electrode. FIG. 5 shows further examples of the type of perforations that may be advantageous to use when a perforated foil 5 is used as the cleaning member. In FIG. 5*a*, the foil 5 is perforated with a more or less central perforation. In FIG. 5*b*, the foil 5 is perforated by a more or less central cross, in which the needle tip may protrude through the centre of the cross. In FIG. 5*c*, the foil 5 is perforated by a more or less triangular perforation, and the needle-tip may protrude through the centre of the triangle, i.e. where the three "lines" or slits meet. A soft non-brittle foil material may be used as the foil 5, which may be cut without incurring any substantial loss of foil material from the position where cutting has occurred, which means that the edges of the perforations are still able to touch each other after the perforations have been cut. As a result, when the needle-tip electrode 4 protrudes through the central part of the perforation, the foil 5 exerts a shearing force onto the electrode 4 along its entire circumference.

The person skilled in the art realizes that the present invention by no means is limited to the preferred embodiment described above. On the contrary, many modifications and variations are possible within the scope of the appended claims. For example, the actuator may be of another type than an electromechanical actuator.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. An ionization electrode, comprising:

an air-ionizing part, wherein the air-ionizing part comprises a needle-tip or a thin wire; and a cleaning device for cleaning the air-ionizing part, wherein the cleaning device comprises:

a cleaning member arranged to be in physical contact with a circumference of the needle-tip or the thin-wire, wherein the air-ionizing part and the cleaning member are configured to be capable of sliding relative to each other; and an actuator arranged to activate a relative motion between the air-ionizing part of the electrode and the cleaning member, wherein the cleaning member comprises a sheet containing at least one perforation through which the air-ionizing part slides, wherein the at least one perforation is substantially closed by edges in contact with each other when the needle-tip or the thin wire does not protrude through the at least one perforation, and wherein a shearing force applied by the cleaning member to the needle-tip or the thin-wire is depends on a thickness of the sheet.

2. The ionization electrode of claim 1, wherein the cleaning member is arranged to move relative to the air-ionizing part.

3. The ionization electrode of claim 1, wherein the ionization electrode is located in an ultrafine particle sensor.

4. The ionization electrode of claim 1, wherein the ionization electrode is located in an air ionizer.

5. The ionization electrode of claim 1, wherein the ionization electrode is located in an electrostatic air cleaner.

6. The ionization electrode of claim 1, wherein the actuator is an electromagnetic assembly comprising a spring, an electrical-wire coil and a magnet.

7. The ionization electrode of claim 6, further comprising:

a piston surrounding at least a portion of the air-ionizing part, wherein the piston is attached to the cleaning part, and wherein the piston comprises the magnet; and a support member surrounding at least a portion of the piston, wherein the support member comprises the electrical-wire coil, wherein the piston is spring-loaded is in the support member by the spring, wherein the piston and cleaning member are configured to slide with respect to the air-ionizing part and with respect to the support member in response to activation of the actuator passing a current through the electrical-wire coil to exert a magnetic force on the magnet.

8. The ionization electrode of claim 1, wherein the cleaning member comprises a flexible porous fibrous material.

9. The ionization electrode of claim 1, wherein the cleaning member comprises a supported granular material.

* * * * *